United States Patent [19]

Li et al.

[11] Patent Number: 5,032,947

[45] Date of Patent: Jul. 16, 1991

[54] METHOD OF IMPROVING MAGNETIC DEVICES BY APPLYING AC OR PULSED CURRENT

[75] Inventors: James C. M. Li, 39 Crestriew Dr., Pittsford, N.Y. 14534; Der-Ray Huang, Taoyuan Hsien, Taiwan

[73] Assignees: James C. M. Li, Pittsford, N.Y.; China Steel Corporation, Kaohsiung, Taiwan

[21] Appl. No.: 378,648

[22] Filed: Jul. 12, 1989

[51] Int. Cl.[5] ..... H01F 13/00; C21D 1/04

[52] U.S. Cl. ..... 361/143; 148/108; 335/284; 335/297

[58] Field of Search ..... 361/139, 140, 143; 336/233; 335/296, 297, 299, 284; 219/10.41, 10.57, 50, 59.1, 61.2, 67, 121.11; 148/121, 122, 108, 103; 29/602.1, 607-609, DIG. 13, DIG. 95; 75/10.1, 10.12; 324/200

[56] References Cited

U.S. PATENT DOCUMENTS 4,311,539 1/1982 Uedaira et al. ..... 148/121
4,528,481 7/1985 Becker et al. ..... 315/248
4,554,029 11/1985 Schoen et al. ..... 148/112
4,842,656 6/1989 Maines et al. ..... 148/302
4,889,568 12/1989 Datta et al. ..... 148/108
4,900,374 2/1990 Panchanathan ..... 148/101

*Primary Examiner*—A. D. Pellinen
*Assistant Examiner*—David Osborn
*Attorney, Agent, or Firm*—Ladas & Parry

[57] ABSTRACT

A method of improving the magnetic properties of a ferromagnetic materials is disclosed. The method comprises a step of providing a specimen made of Fe, Ni or Co based amorphous alloys in a magnetizing field and a second step of applying an AC current or pulsed current on the specimen to improve its soft magnetic properties. The applied AC current has a frequency of 50 to 50K Hz, a wave form of either sine wave, triangular wave or square wave, and a current density of 10 to 500 A/cm$^2$. The magnetic properties of the ferromagnetic materials are improved by a coercivity ratio less than 0.5, a magnetic induction ratio greater than 1 and a core loss ratio less than 0.3.

8 Claims, 6 Drawing Sheets

METHOD OF IMPROVING MAGNETIC DEVICES BY APPLYING AC OR PULSED CURRENT

BACKGROUND OF THE INVENTION

The present invention relates to a method for improving the magnetic properties of a magnetic material, and more particularly relates to a method for improving the magnetic properties of ferromagnetic amorphous alloys by applying AC current or pulsed current.

Ferromagnetic amorphous alloys have been widely used in many magnetic applications such as distribution transformers, DC power supplies, motors, current amplifiers, magnetic shielding, etc. Fe-base amorphous alloys will produce an annealing embrittlement after the conventional furnace annealing. This is a serious problem in a certain applications.

In the past, efforts have been made to find new magnetic materials suitable for many applications with better magnetic properties such as higher magnetic induction (Bm), lower coercivity (Hc), and therefore low core loss when the transformer core is made of such materials. For ferromagnetic materials used in the past for the manufacture of transformer cores, it is very difficult to change their magnetic properties in operation.

SUMMARY OF THE INVENTION

It is therefore the main object of the present invention to provide a method for improving the magnetic properties of the ferromagnetic amorphous alloys.

An important feature of the present invention is the step of applying an AC current or pulsed current to the ferromagnetic amorphous alloys during the magnetization of the alloys to increase the maximum value of the magnetic induction (Bm) and decrease the minimum value of the coercivity (Hc).

The AC current is originated from an AC power supply and fed into the specimen of the ferromagnetic materials by directly connecting to a pair of electrodes thereof. It is believed that the current passing the ferromagnetic material causes the domain wall in the material to shift in responsive to the current density and frequency. Therefore, the soft magnetic properties of the ferromagnetic materials are improved. The method of the present invention further comprises a step of applying an AC current or pulsed current to a specimen of alloy which has been treated by AC Joule heating or pulsed high current heating process. This amorphous alloy will not have annealing embrittlement during annealing process. The AC Joule heating or pulsed high current processes for improving the magnetic properties and annealing embrittlement of the alloy is invented by the same inventors of this subject invention and is detailed in co-pending application Ser. No. 338,895, now abandoned.

The applied AC current or pulsed current has a frequency ranged from 50 to 50K Hz, a current density of 10 to 500 A/cm$^2$ and a wave form of sine wave, triangular wave or square wave.

Accordingly, the method of improving the magnetic properties of ferromagnetic amorphous alloys of the present invention comprises a first step of providing a ferromagnetic amorphous alloy specimen in a magnetizing field, a second step of applying an AC current or pulsed current passing through said specimen, and a third step of detecting and recording the magnetic induction and coercivity of said specimen during magnetization and demagnetization process.

BRIEF DESCRIPTION OF THE DRAWINGS

Those and other advantages, objects and features of the method according to the present invention will become apparent from the following detailed description of the preferred embodiments with reference to the accompanying drawings.

DETAILED DESCRIPTION OF THE PREFERRED EMBODIMENTS

The method for improving the magnetic properties of ferromagnetic amorphous alloys by applying high AC current or pulsed current is carried out and will become apparent in the following procedure.

1. Specimens

Ferromagnetic amorphous ribbons with different compositions, especially for Fe and Ni base amorphous ribbons. Also it is suitable for all crystalline material.

Specimen shape -straight long ribbon toroid core wound by a long ribbon

C-type, E-type or rectangular type core

In our experiments, specimen of composition $Fe_{78}B_{13}Si_9$ were made into straight and toroidal shapes.

Figure 1:
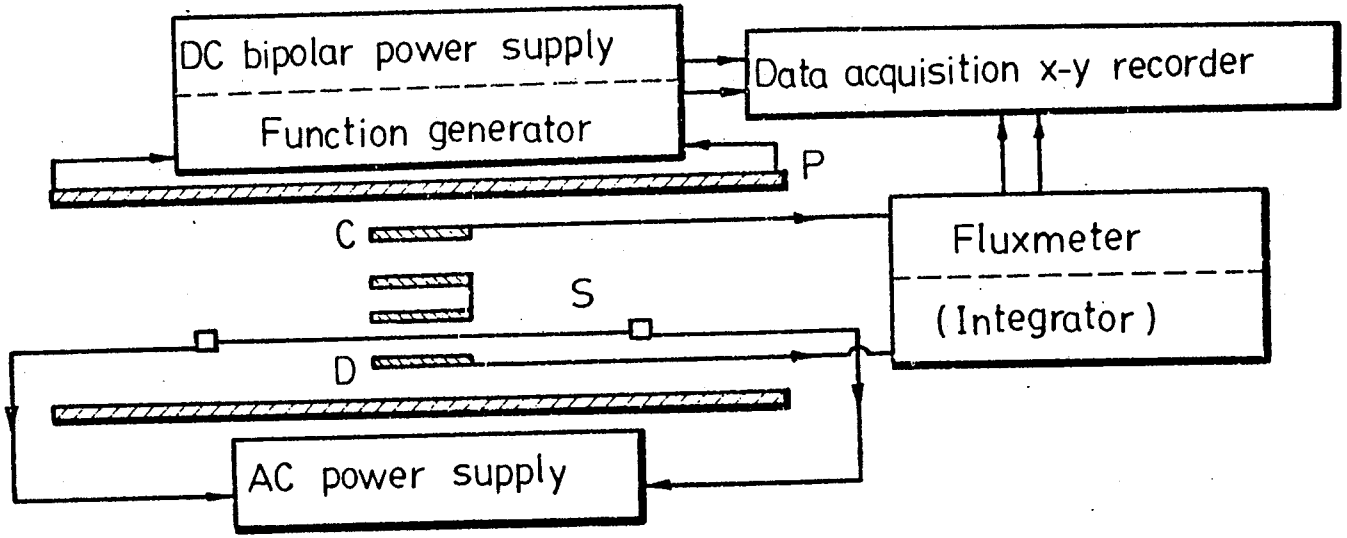
FIG. 1 is a schematic diagram of the system for measuring B-H loop of a straight specimen according to the method of the present invention.

2. Measuring the magnetic properties with AC current or pulsed current passing through the specimen A. Straight specimen The straight specimen was put in the center of a uniform magnetic field (H) produced by a long solenoid coil which was connected to a DC bipolar power supply of a function generator. Both ends of the straight amorphous ribbon were clamped by two square copper plates which were connected to the output terminals of an AC power supply which is capable of producing a search coil (S) combined with a compensating coil (C) was connected to a fluxmeter (or integrator) to measure the magnetic flux density (B) of the specimen. By connecting the terminals of the applied magnetic field (H) and magnetic flux density (B) to a X-Y recorder, the B-H hysteresis loop was obtained. (FIG. 1)

B. Toroidal specimen

Figure 2:
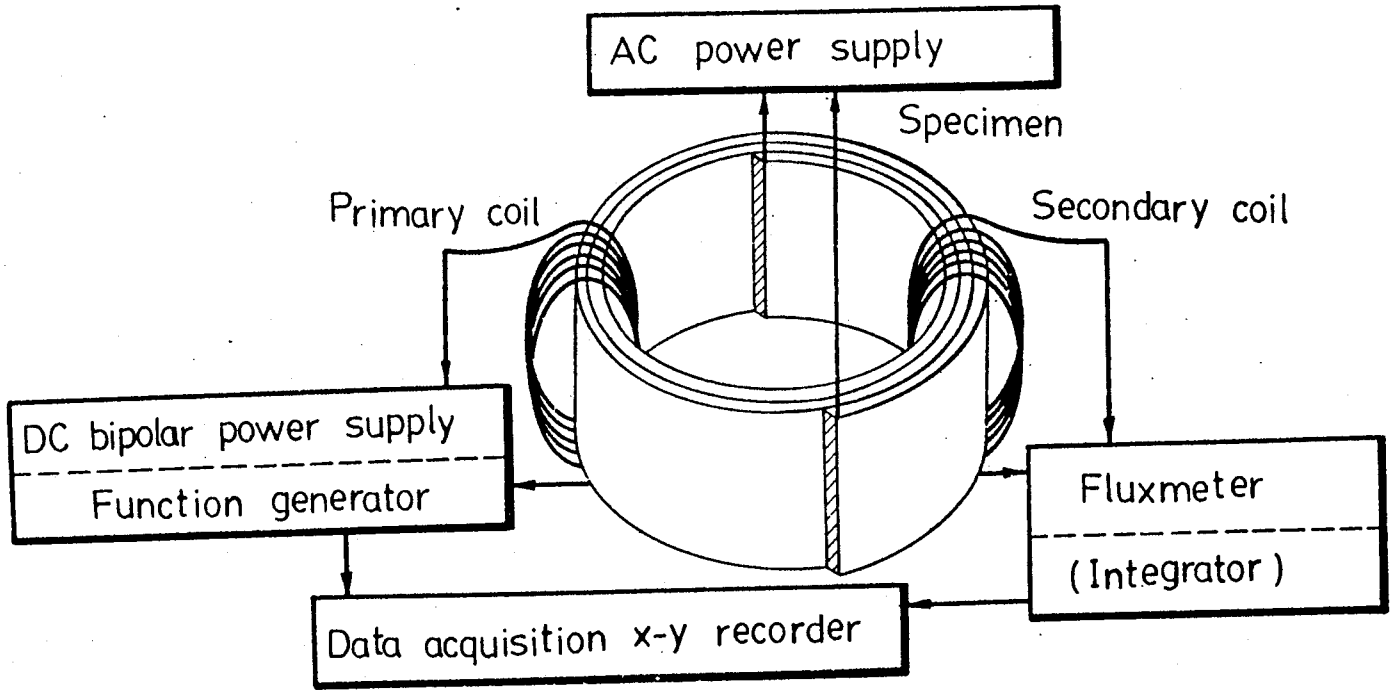
FIG. 2 is a schematic diagram of the system for measuring B-H loop of a toroidal specimen according to the method of the present invention.

The toroidal specimen was made by winding a long amorphous ribbon coated with insulation materials. The two ends of the long ribbon were connected to the output terminals of the AC power supply. The toroidal core was wound by two coils, the primary coil ($N_1$) was connected to a DC bipolar power supply or a function generator to produce the applied magnetic field (H), a and the second coil ($N_2$) was connected to a fluxmeter (or integrator) to measure the magnetic flux density (B). Then, by connecting the terminals of H and B to a X-Y recorder, the B-H hysteresis loop was obtained. (FIG. 2)

3. Conditions of the applied AC current through the specimen.

frequency range: 50 Hz ~ 50KHz wave form: sine wave, triangular wave and square wave current density: $J=10\ A/cm^2 \sim 5\times10^2\ A/cm^2$ Transverse field induced by AC current or pulsed current.

Figure 3:
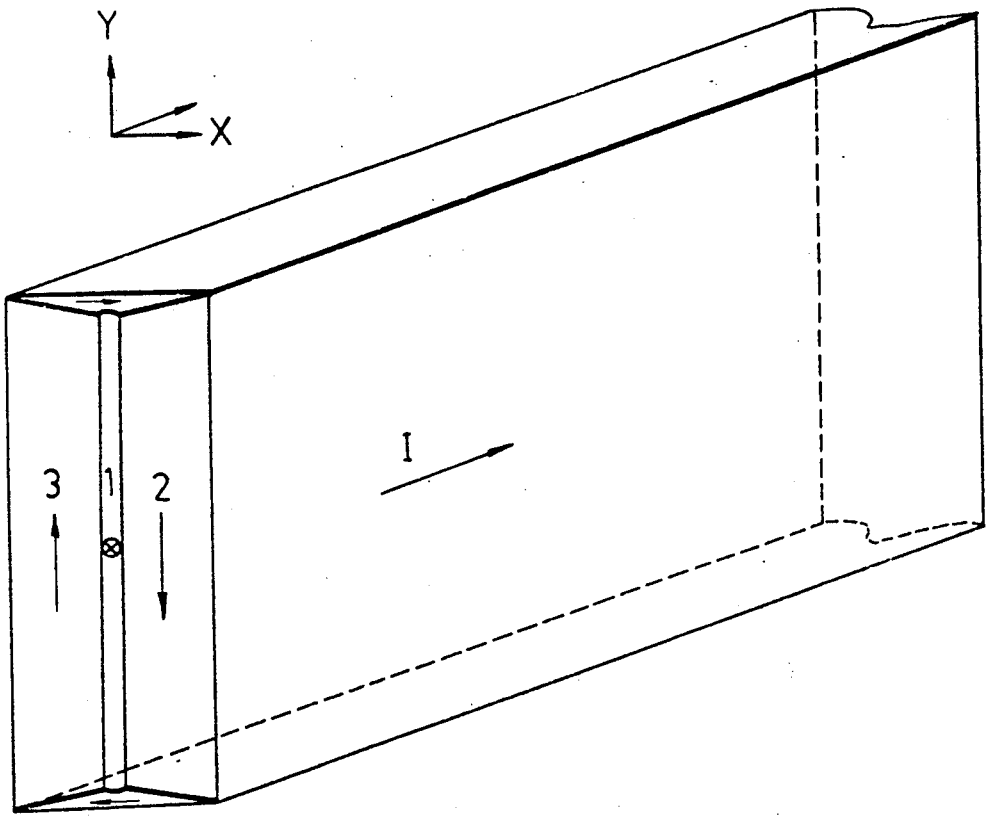
FIG. 3 is a perspective view of an ferromagnetic amorphous alloy ribbon showing its magnetic domain structure.

Except in the vicinity of the ribbon edges, the magnetic field produced by applying a current I through a rectangular specimen is essentially transverse and varies linearly with distance from the ribbon midplane. FIG. 3 shows the cross section of amorphous ribbon and its possible magnetic domain structure.

4. Examples of improvement on the various kinds of ferromagnetic amorphous alloys resulted from the method of the invention by applying AC current passing through the specimen made of ferromagnetic materials.

EXAMPLE 1

Specimen: straight shape (15.24 cm × 3.05 mm × 25 μm)

Composition: $Fe_{78}B_{13}Si_9$

Reference magnetic properties of as-cast specimen:

When applied magnetic field: Hm = ±0.296 Oe a. magnetic induction: $Bm_o = 7.16$ KG b. coercive force: $Hc_o = 0.074$ Oe Effects of magnetic properties under AC current passing through the specimen:

A. Dependence of AC current density

Figure 4:
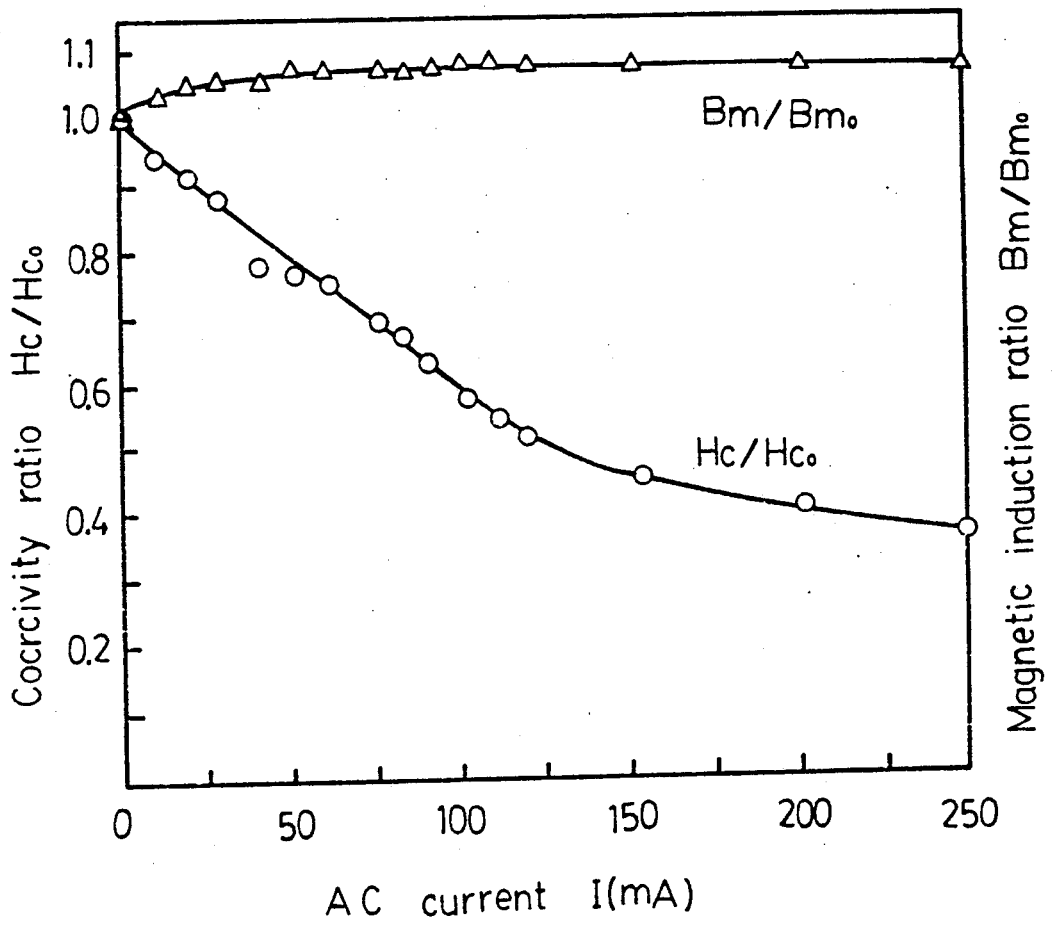
FIG. 4 is a chart showing variation of magnetic induction and coercivity of a $Fe_{78}B_{13}Si_9$ straight specimen with a 60 Hz sine wave current passing thereon.

When a 60 Hz sine wave current passing through the specimen with different current density $J=0\sim3.34\times10^2\ A/cm^2 (I=0\sim250\ mA)$, the variations of the magnetic induction and coercivity of the specimen are shown in FIG. 4. The magnetic inductions under different current densities are almost the same which is a little higher than the value of as-cast specimen. However, the coercivity of the specimen decreases significantly as the current density increases. The decrease is slower after the current density is higher than $1.5\times10^2\ A/cm^2$. When the current density is $3.34\times10^2\ A/cm^2$, the coercivity will be lower than one half value of the as-cast specimen.

B. Frequency dependence

Figure 5:
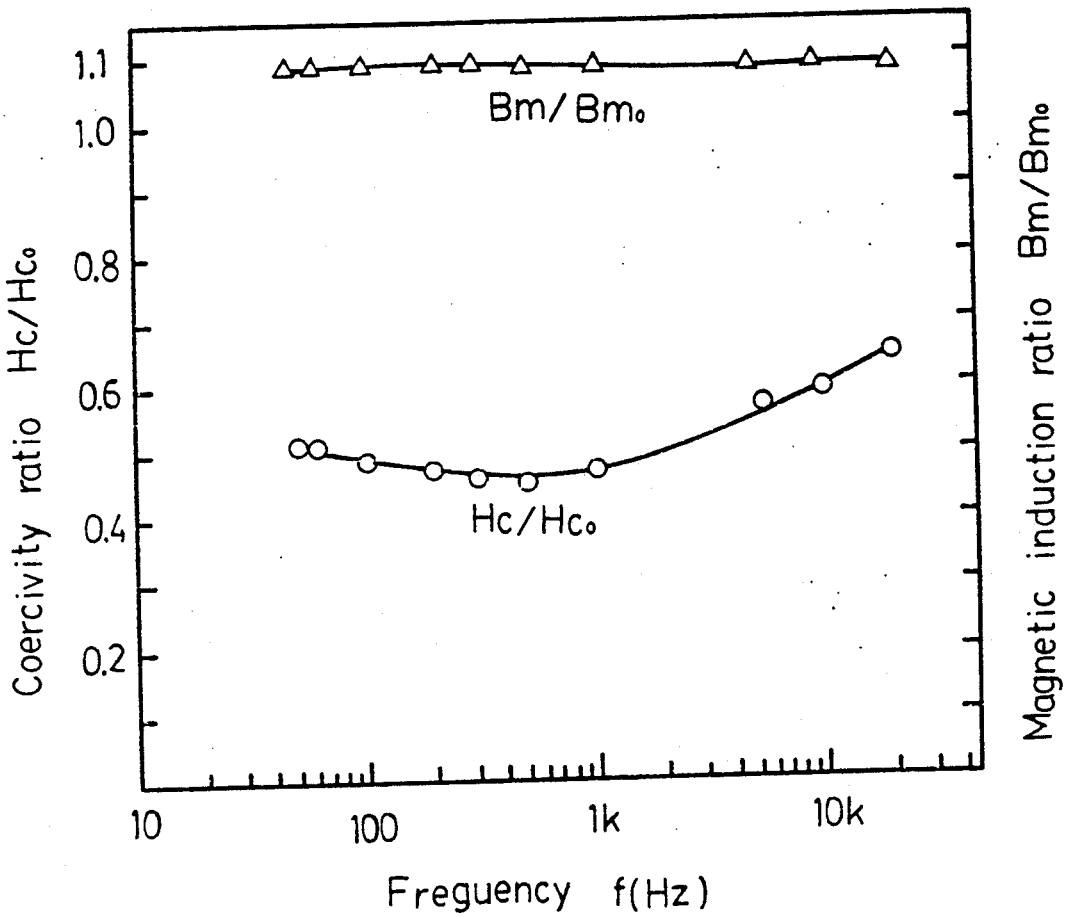
FIG. 5 is a chart showing variation of magnetic induction and coercivity of a $Fe_{78}B_{13}Si_9$ straight specimen carrying AC current with different frequencies.

When the specimen was carrying the same AC current (current density $J=1.6\times10^2\ A/cm^2$) with different frequency (50 Hz ~ 20 KHz), the variations of magnetic induction and coercivity of the specimen are shown in the FIG. 5. Also, the magnetic inductions are almost the same and a little higher than the value of as-cast specimen. The values of coercivity ratio are around 0.5 and the minimum values of coercivity are between the frequency range 100 Hz ~ 1 KHz.

C. Wave form dependence

The wave form used in the AC current passing through the specimen may be sine wave, triangular wave and square wave. Under the same peak-peak current, the effect of improving the magnetic properties by square wave is the best, and the effects by sine wave and by triangular wave are almost the same. For 300 Hz current passing through the specimen, the variations of magnetic induction and coercivity when applied magnetic field is Hm = ±0.296 Oe are list as follows:

| wave form | current(mA) | Bm(KG) | Hc(Oe) |
|---|---|---|---|
| | 0 | 7.16 | 0.074 |
| sine | 200 | 7.72 | 0.044 |
| triangle | 200 | 7.72 | 0.044 |
| square | 200 | 7.72 | 0.044 |
| sine | 250 | 7.86 | 0.029 |
| triangle | 250 | 7.86 | 0.029 |
| square | 250 | 7.86 | 0.026 |

EXAMPLE 2

Specimen: toroidal specimen

Composition: $Fe_{78}B_{13}Si_9$

A 5-layer amorphous core with diameter 3.8 cm was wound by a 60 cm long ribbon (width 7.5 cm, thickness 25 μm, and weight 6.623 g)

Reference magnetic properties of as-cast specimen:

When applied magnetic field in measuring B-H loop is Hm = ±0.15 Oe a. magnetic induction Bm = 6.71 KG b. coercivity $Hc_o = 0.073$ Oe Applying 60 Hz sine wave through the core, the improved magnetic induction and coercivity of the specimen are list follows:

| Current density J(A/cm²) | Bm(KG) | Hc(Oe) |
|---|---|---|
| 0 | 6.71 | 0.073 |
| $2\times10^2$ | 6.80 | 0.039 |
| $5\times10^2$ | 6.88 | 0.030 |

EXAMPLE 3

Specimen: straight shape (15 cm × 3.05 mm × 25 μm)

Composition: $Fe_{78}B_{13}Si_9$

A. As-cast specimen

When applied magnetic field in measuring B-H loop is Hm = ±0.292 Oe magnetic induction Bm = 7.07 KG coercive force Hc = 0.075 Oe B. After AC Joule heating Conditions of AC Joule heating:

frequency f = 60 Hz current density $J=3.0\times10^3\ A/cm^2$ heating time $t_h = 50$ sec applied field Hp = 100 Oe When applied magnetic field in measuring B-H loop is Hm = ±0.292 Oe magnetic induction Bm = 9.70 KG coercivity Hc = 0.04 Oe And, fracture strain $\epsilon_f = 1$ (ductility)

C. Passing AC current through the specimen after AC Joule heating

Figure 6:
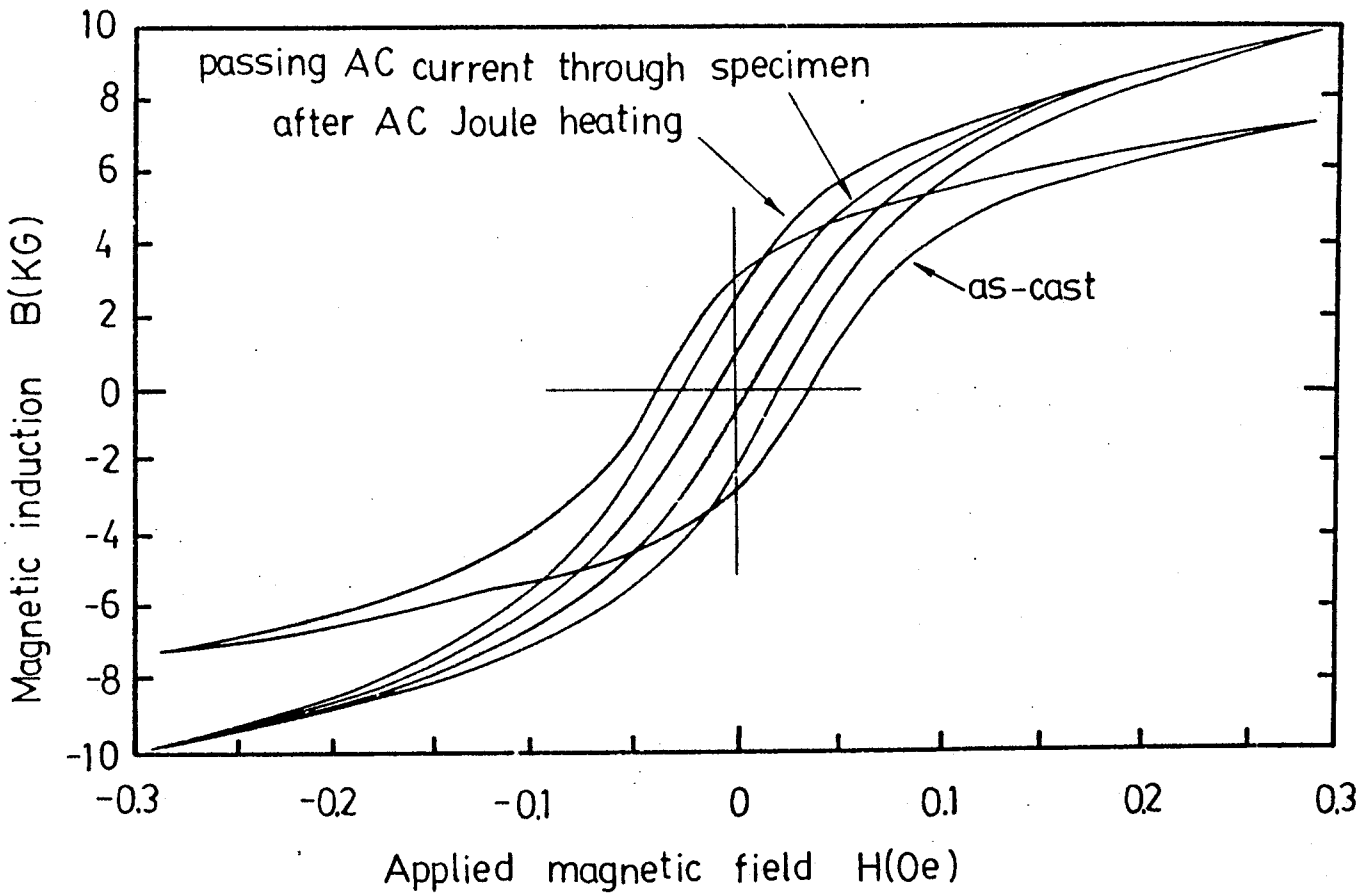
FIG. 6 is a chart for the B-H loop of a $Fe_{78}B_{13}Si_9$ straight specimen as-cast after; AC Joule heating and by applying AC current therethrough.

Conditions of AC current frequency: f = 300 Hz wave form: square current density: $1.6\times10^2\ A/cm^2$ When applied magnetic field in measuring B-H loop is Hm = ±0.292 Oe magnetic induction Bm = 9.89 KG coercivity Hc = 0.017 Oe The dc B-H loops of the specimen as-cast, after AC Joule heating and AC current passing through the specimen are shown in FIG. 6.

Although the method of the present invention has been described by way of preferred embodiments, it is to be noted that changes are still possible for those skilled in the art without departing from the spirit of the invention.

What is claimed is:

1. A method of improving the magnetic properties of a magnetic device in which ferromagnetic material is used, comprising the steps of:

(a) connecting a power supply in series with said ferromagnetic material, said power supply capable of producing an AC or pulsed current, and (b) applying said AC or pulsed current to said ferromagnetic material during magnetization of said device.

2. The method of claim 1, further comprising a step of recording the improved magnetic properties of said magnetic device.

3. The method of claim 2, wherein said step of recording comprises, detecting a magnetic field applied to said magnetic device during said magnetization, detecting magnetic flux density of said device, and recording said detected magnetic field and magnetic flux density.

4. The method of claim 1, wherein said ferromagnetic material is selected from the group consisting of Fe-base amorphous alloy, Ni-base amorphous alloy and Co-base amorphous alloy.

5. The method of claim 1, wherein said step (b) is to apply an AC current having a frequency within a range of 50 to 50K Hz.

6. The method of claim 1, wherein said step (b) is to apply an AC current having a wave form of sine wave, triangular wave or square wave.

7. The method of claim 1, wherein said step (b) is to apply an AC current with a current density of 10 to 500 $A/cm^2$.

8. The method of claim 1, wherein said ferromagnetic material comprises a straight shape, toroidal shape or transformer core shape.

* * * * *